US008424268B2

(12) United States Patent
Field et al.

(10) Patent No.: US 8,424,268 B2
(45) Date of Patent: Apr. 23, 2013

(54) GRID MEMBERS FOR A SUSPENDED CEILING AND METHODS OF MAKING SAME

(75) Inventors: Graham Keith Field, Newcastle (GB); Thomas Andreas Voigt, Neuss (DE)

(73) Assignee: USG Interiors, LLC, Chicago, IL (US)

( * ) Notice: Subject to any disclaimer, the term of this patent is extended or adjusted under 35 U.S.C. 154(b) by 20 days.

(21) Appl. No.: 12/747,540

(22) PCT Filed: Jan. 7, 2009

(86) PCT No.: PCT/GB2009/000034

§ 371 (c)(1),
(2), (4) Date: Oct. 20, 2010

(87) PCT Pub. No.: WO2009/087378

PCT Pub. Date: Jul. 16, 2009

(65) Prior Publication Data

US 2011/0023400 A1 Feb. 3, 2011

(30) Foreign Application Priority Data

Jan. 11, 2008 (GB) ..... 0800496.2

(51) Int. Cl.
*E04C 3/07* (2006.01)
*E04B 9/18* (2006.01)

(52) U.S. Cl.
USPC ..... 52/846; 52/506.07

(58) Field of Classification Search ..... 52/506.06, 52/506.07, 846, 847, 852; 156/182, 196, 156/204
See application file for complete search history.

(56) References Cited

U.S. PATENT DOCUMENTS 2,059,483 A * 11/1936 Parsons ..... 52/506.06
3,270,479 A * 9/1966 Weinar ..... 52/667
3,730,798 A * 5/1973 Franz ..... 156/201
(Continued)

FOREIGN PATENT DOCUMENTS

CN 2263685 Y 10/1997
DE 3415278 A1 4/1984
(Continued)

OTHER PUBLICATIONS

Notification of Transmittal of The International Search Report and The Written Opinion of The International Searching Authority, or the Declaration, International Search Report dated Mar. 16, 2009, Written Opinion of the International Searching Authority, International Application No. PCT/GB2009/000034, International Filing Date Jan. 7, 2009.

*Primary Examiner* — Christine T Cajilig
(74) *Attorney, Agent, or Firm* — Pearne & Gordon LLP

(57) ABSTRACT

Grid members, namely a runner (10) and wall angle (400) for suspended ceiling grids, are disclosed. Certain embodiments of the runner and the wall angle have two web portions (28, 30) and at least one distinct indent portion (62) to define a space between the web portions. An adhesive (56) may be disposed within one or more of the indent portions (62) to adhere the two web portions (28, 30) to each other. Certain embodiments of the runner or wall angle have flange portions (32, 34) that may have indent portions as well. One or more of these indent portions may contain adhesive. Some embodiments of the runner or wall angle have overturned cap portions on the flange portions, and an adhesive may be placed between the overturned cap portions and upwardly facing surfaces of the flange portions.

17 Claims, 4 Drawing Sheets

U.S. PATENT DOCUMENTS

| | | | | | |
|---|---|---|---|---|---|
| 3,828,507 | A | | 8/1974 | Storer | |
| 3,928,950 | A | * | 12/1975 | Beynon | 52/506.07 |
| 4,206,578 | A | | 6/1980 | Mieyal | |
| 4,489,529 | A | | 12/1984 | Ollinger et al. | |
| 4,505,083 | A | * | 3/1985 | Mieyal | 52/476 |
| 4,554,718 | A | * | 11/1985 | Ollinger et al. | 52/506.07 |
| D288,615 | S | | 3/1987 | Hardy | |
| 4,817,357 | A | * | 4/1989 | Hocevar | 52/506.07 |
| 4,852,325 | A | | 8/1989 | Dunn et al. | |
| 4,991,373 | A | | 2/1991 | Shaub | |
| 5,076,036 | A | * | 12/1991 | Kuiper | 52/506.07 |
| 5,325,647 | A | | 7/1994 | Forry et al. | |
| 5,572,844 | A | | 11/1996 | Stackenwalt et al. | |
| 5,619,833 | A | | 4/1997 | Neff | |
| 5,893,249 | A | | 4/1999 | Peterson et al. | |
| 6,041,564 | A | | 3/2000 | Shirey | |
| 6,318,042 | B1 | | 11/2001 | Bloom et al. | |
| 6,389,771 | B1 | | 5/2002 | Moller | |
| D467,007 | S | | 12/2002 | Daudet et al. | |
| 7,278,243 | B2 | * | 10/2007 | Jones et al. | 52/506.07 |
| 7,677,004 | B2 | | 3/2010 | LaLonde | |
| 2002/0083655 | A1 | | 7/2002 | Paul et al. | |
| 2004/0194417 | A1 | | 10/2004 | Paul | |
| 2007/0028554 | A1 | | 2/2007 | Ferrell et al. | |
| 2007/0125038 | A1 | | 6/2007 | Lehane, Jr. et al. | |
| 2008/0083521 | A1 | * | 4/2008 | Gelli | 162/118 |

FOREIGN PATENT DOCUMENTS

| | | | |
|---|---|---|---|
| DE | 19711316 | A1 | 3/1996 |
| EP | 0037061 | B1 | 10/1981 |
| EP | 0387964 | A1 | 9/1990 |
| EP | 0492818 | A1 | 7/1992 |
| GB | 2026586 | A | 2/1980 |
| GB | 2125845 | A | 3/1984 |
| GB | 2389375 | A | 12/2003 |
| JP | 5-163794 | A | 12/1991 |
| NL | 9400938 | A | 1/1996 |
| WO | 0029689 | A1 | 5/2000 |
| WO | 2007061524 | A2 | 5/2007 |

* cited by examiner

GRID MEMBERS FOR A SUSPENDED CEILING AND METHODS OF MAKING SAME

TECHNICAL FIELD

This invention relates generally to grid members for suspended ceilings and, more particularly, to elements such as runners or wall angles used in a suspended ceiling grid to support ceiling panels and to the manufacture of the runners or wall angles.

BACKGROUND

Suspended ceiling systems are widely used in a variety of applications, such as in commercial and residential buildings. Grid-type suspension ceilings cover the plenum area, while still allowing access to the plenum area, which typically contains components of the building's wiring, heating, venting, air conditioning, and plumbing systems, among other mechanical components. A grid of spaced runners and cross-runners are frequently used to position and support the panels. Ceiling tiles or panels are commonly supported in the grid by laying the perimeter of such panels on the panel-support flanges of the runners. The runners and cross-runners are generally suspended from the ceiling using wires, rods, or other suspension runners, among other means, and are arranged and sized according to the shape and size of the panels being supported therein.

The runners are typically made of strips of sheet metal of a minimum thickness folded in a particular cross-section or profile in order to provide an acceptable level of flexural load bearing capacity with relatively little visible downward deflection to safely support the ceiling panels during regular use and during fires as well as to provide an aesthetically pleasing appearance. The sheet metal runners also have a desirable torsional stiffness so that the runners can be easily manipulated when the runners are being hung from a ceiling and attached to other runners during assembly of the ceiling grid. However, the relatively thick sheet metal used to form the runners as well as the relatively large cross-section or profile of the runners increases both the costs of shipping and manufacturing such runners.

One way to strengthen the runner so that a thinner sheet metal can be used and/or so that the cross-section of the runner can be reduced is to interconnect overlapping layers of the runner to form a shear rigid bond between the layers, thereby more effectively absorbing and spreading forces over the overlapping parts of the runner. For instance, inverted T-shaped runners ("grid tees") have a vertical stalk connected at its base to a horizontal flange and are manufactured by bending a piece of sheet metal so that two opposing plates or webs form the stalk. A bottom plate or capping forms the bottom of the grid tee to cover the crack formed between the two webs forming the stalk. The flange is formed by bending the bottom of each web to extend outward to form two tables on which the capping is placed. When the two webs forming the stalk are connected to each other by an additional fastener, the fastener absorbs torsional forces and spreads the forces more evenly over both webs, thereby reducing the twisting of the webs. Similarly, interconnecting the tables with the capping absorbs and distributes forces resulting in increased flexural load carrying capacity.

One way to interconnect the overlapping webs or layers of the runner is to use adhesive. Using adhesive, however, can cause extra wear and damage to forming tools such as roll formers, presses, or punches that are used to form the runner but that come into contact with the adhesive. This occurs when the roll formers cut and fold the sheet metal into the general shape of the runner and/or the presses form penetrations used to attach further metal parts (clips or splices for example) to the runner or to create openings for cross-tee grid runners or wire hangers required for the installation of the finished grid products. Adhesive that collects on the forming tools may cause the tools to make imprecise cuts, require greater force to make the cuts, cause the tools to malfunction or jam, or may cause an undesirable thermo or chemical reaction with the tools or other parts or machines near the tools resulting in accelerated wear.

It is an object of certain embodiments of the invention to mitigate one or more of these disadvantages.

Another problem is that the adhesive may flow and collect in the folds of the runner. In this case, the pooled adhesive may not compress sufficiently for proper folding of the runner so that its overlapping webs can abut each other. This results in a runner with poor structural characteristics.

To prevent these problems, a high viscosity adhesive may be used that generally cannot flow to parts of the runner that will come into contact with the forming tools. In certain situations, however, a high viscosity adhesive may not be practical. For instance, it may be otherwise more efficient or economical to use low viscosity hot melt or moisture cured adhesives, or application methods such as spraying or certain bead application processes may require a low viscosity adhesive. Furthermore, even with high viscosity adhesives, some manufacturing line speeds move the runners and/or adhesive application equipment so fast that even high viscosity adhesive will be splashed to parts of the runner that receive a forming tool. Finally, some adhesives harden and expand as they set. In these cases, the expandable and hardening adhesives placed between overlapping webs on the runner may undesirably bend or deform the webs as it expands.

According to a first aspect of the invention, there is provided an element for use in a suspended ceiling grid, comprising:

a stalk portion;

a flange portion;

the stalk and flange portion being connected;

and in at least one of the stalk and flange portion, an indent portion adapted to provide an increase in torsional resistance of the element.

The flange portion may extend laterally on one side of the plane of the stalk portion whereby to provide an element of substantially L-shape in end elevation.

Alternatively, the flange portion may extend laterally on both sides of the plane of the stalk portion, whereby to provide an element of substantially T-shape in end elevation.

There may be at least one distinct indent portion.

Suitably, the stalk portion may comprise at least two substantially parallel opposed web portions.

The flange portion may comprise an upper in use portion with an upwardly facing surface, a capping portion generally disposed beneath in use the upper portion, and at least one overturned portion adapted to connect the upper in use portion and the capping portion.

In a preferred embodiment the overturned portion may extend from below the upper portion to above the upwardly facing surface of the upper in use portion.

There may be an adhesive disposed in one or more of the at least one indent portions.

Suitably, the two opposed web portions may each comprise at least one indent portion.

For ease of manufacture and/or use, the indent portions in opposed web portions may be opposed.

The at least one indent portion may define at least one channel extending longitudinally of the element.

There may be at least two channels which may be substantially parallel with one another and there may be adhesive disposed in more than one of the at least two channels.

There may be adhesive disposed between the upwardly facing surface and the overturned portion.

Suitably, the adhesive may comprise a low viscosity adhesive.

The element may comprise a runner for a suspended ceiling grid, or alternatively may comprise a wall angle for a suspended ceiling grid.

According to a second aspect, the invention provides a runner for a suspended ceiling grid, comprising:

two opposing web portions;

two flange portions;

at least one distinct indent portion;

the at least one indent portion located on at least one of the web portions; or at least one of the flange portions; or at least one of the web portions and at least one of the flange portions.

According to a third aspect, the invention provides a runner for a suspended ceiling grid, comprising:

an upper portion with an upwardly facing surface;

a lower capping portion generally disposed beneath the upper portion;

at least one overturned portion to connect the lower capping portion to the upper portion, the at least one overturned portion extending from below the upper portion to above the upwardly facing surface of the upper portion; and an adhesive disposed between the upwardly facing surface and the at least one overturned portion.

According to a fourth aspect, the invention provides a runner for a suspended ceiling grid, comprising;

an upper portion with at least one overturned end portion; and a lower capping portion with at least one overturned end portion configured and disposed so that the at least one overturned end portion of the lower capping portion extends around the at least one overturned end portion of the upper portion.

According to a fifth aspect, the invention provides a method of forming an element for a suspended ceiling grid, comprising the steps of:

forming at least one indent on a web member;

placing an adhesive in one or more of the at least one indent; and after placing the adhesive in one or more of the at least one indent, moving a forming tool on the web member, wherein the at least one indent that contains the adhesive provides sufficient space to substantially maintain the adhesive out of contact with the forming tool.

According to a sixth aspect, the invention provides a method of forming an element for a suspended ceiling grid, comprising the steps of:

forming at least one indent on a web member;

placing an expandable adhesive in one or more of the at least one indent; and folding the web member to form two opposing web portions wherein the adhesive is disposed between the two opposing web portions, and wherein the at least one indent has sufficient dimensions to permit the adhesive to expand without substantially deforming the web member.

According to a seventh aspect, the invention provides a wall angle for a suspended ceiling grid comprising:

a web portion;

a flange portion;

at least one indent portion;

the at least one indent portion located on the web portion, on the flange portion, or on both the web portion and the flange portion.

DETAILED DESCRIPTION OF THE PREFERRED EMBODIMENTS

Figure 1:
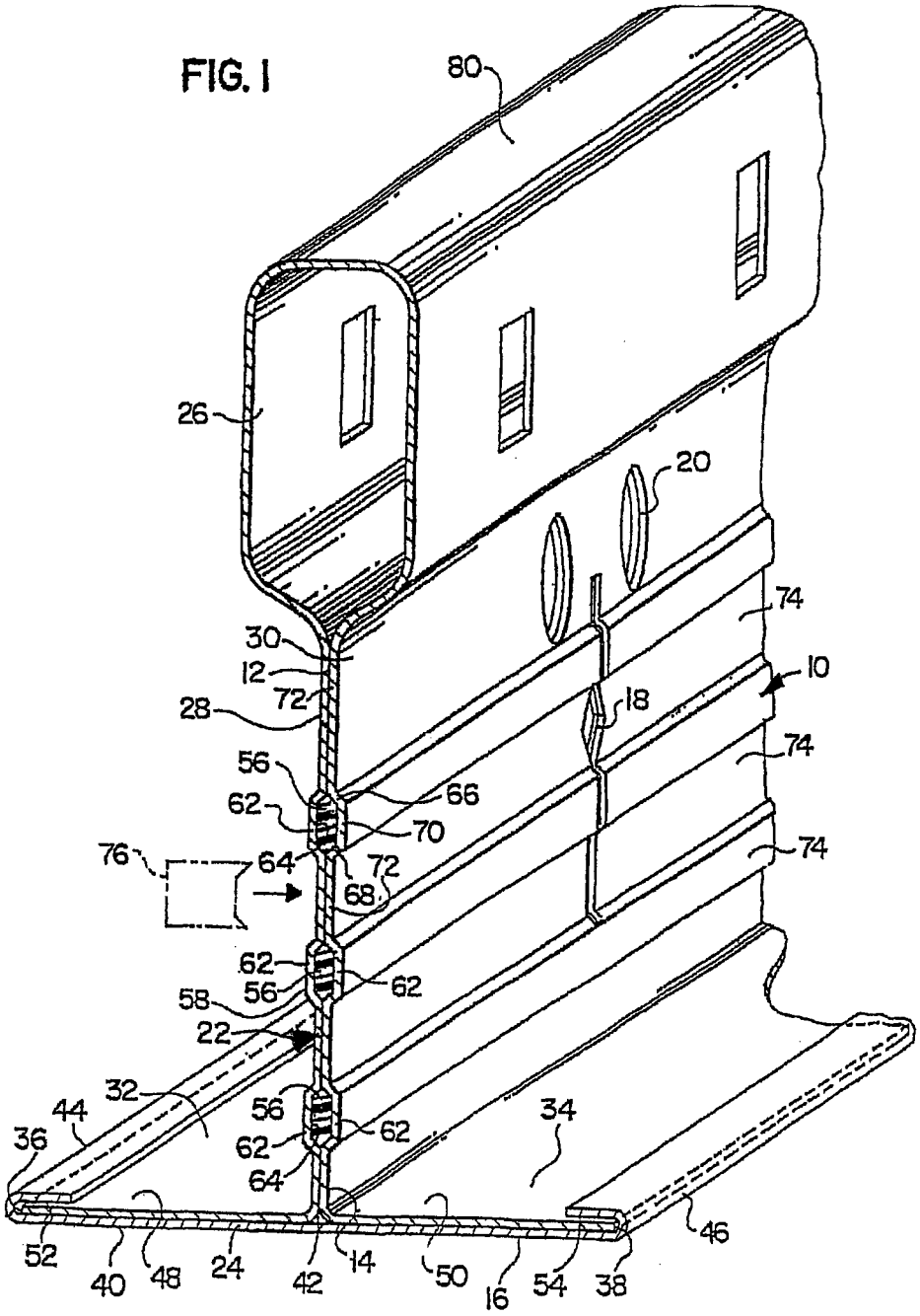
FIG. 1 is a schematic cross-sectional perspective view of a runner for a suspended ceiling grid as configured in accordance with a first embodiment of the present invention.

With reference to FIG. 1, a first embodiment includes a runner 10 for a suspended ceiling grid. The runner 10 is shown to be a main tee grid runner although the features of the invention described herein also apply to cross tee grid runners. The runner 10 has a generally vertically extending stalk 12 connected at its bottom end portion 14 to a transversely or generally horizontally extending flange 16. The stalk 12 can be disposed between adjacent ceiling panels and has openings 18 to connect to cross tee grid runners and openings 20 to connect to hangers extending downward from a building's structural members, such as joists or a concrete slab, for example.

In this embodiment, the runner 10 has an upper portion 22 and a lower portion 24 that, in one embodiment, is formed separately from the upper portion 22. The upper portion 22 forms the stalk 12 while both the upper and lower portions 22 and 24 cooperatively form the flange 16. The stalk 12 has an upper reinforcing bulb 26 forming the terminal upper end 80 of the stalk 12 and two opposing webs 28 and 30 extending downward from the bulb. Each of the webs 28 and 30 is bent outward at the bottom end portion 14 of the stalk 12 to form two diverging, laterally extending left and right tables 32 and 34 with opposing distal ends 36 and 38 respectively.

The lower portion 24 serves, at least in part, as capping that extends beneath at least one of the tables 32 and 34, but for this embodiment extends from one of the distal ends 36 to the other distal end 38. The capping 24 has a solid, continuous plate 40 that covers a non-aesthetically pleasing crack 42 formed between the two opposing webs 28 and 30 that would otherwise be visible from beneath the runner 10. In order to secure the capping 24 to the tables 32 and 34, the capping 24 has two opposite overturned portions 44 and 46 that both curl upwardly and inwardly to extend from beneath the tables 32 and 34, around the distal ends 36 and 38 of the tables, and to above an upper surface 48 and 50 of the tables, respectively. This configuration retains the distal ends 36 and 38 within spaces 52 and 54 that are respectively formed by the overturned portions 44 and 46.

Figure 4:
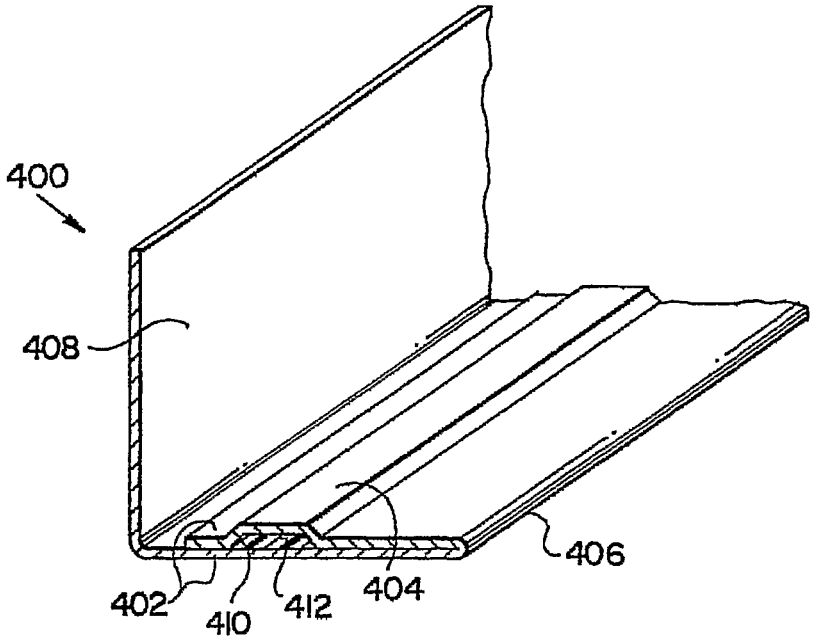
FIG. 4 is a schematic cross-sectional perspective view of a wall angle for a suspended ceiling grid as configured in accordance with a fourth embodiment of the present invention.

For the current embodiment, an adhesive 56 is used to bond two web portions 58 and 60 to each other to strengthen the runner 10. The web portions 58 and 60 may be part of the two opposing webs 28 and 30 (as shown in FIG. 1) and/or may be part of one of the tables 32 or 34 and part of the capping 24 as for the embodiment shown in FIG. 2. Other embodiments may exist wherever a grid piece for a ceiling grid has two opposing, overlapping web portions or layers that can be interconnected by adhesive. Thus, as shown in FIG. 4, it will be understood that other grid pieces such as a wall molding or angle 400 made by overlapping webs 402 also may have the advantageous structure of the embodiments described herein. For example, the wall angle 400 may have at least one indent portion 404 on a flange portion 406 as shown, or additionally or alternatively on a web or stalk portion 408. The indent portion 404 may form an elongate channel 410 and may comprise an adhesive 412, similar to adhesive 56 described herein.

Low viscosity adhesive 56 used with the runners 10 may be moisture cured and/or may comprise a hot melt adhesive. Some possible adhesives may be a polyurethane based adhesive although any other adhesive with sufficient strength, bonding, and other properties discussed herein may be used such as cyanoacrylate adhesives, isocyanate adhesives, and epoxy adhesives to name a few examples. Such adhesives may be in a more liquid form with a relatively lower viscosity than when it is heated and expands as it cools into a solid state.

As mentioned previously, such a low viscosity adhesive 56 may wear, damage, or jam roll formers, punches, presses 76 (shown schematically using dashed lines in FIG. 1), or other forming tools that come into contact with the adhesive. Additionally, space is needed for some types of adhesive to expand into as they cool and harden to prevent damaging or deforming the web portions 58 and 60. To solve these problems, at least one distinct indent portion 62 may be formed by at least one of the web portions 58 and 60 to define a space 64 between the two web portions. The adhesive 56 may be placed within one or more of the indent portions 62 to interconnect the two web portions 58 and 60 to each other.

In the illustrated embodiment, this space 64 is an elongated channel 74 formed by an indent portion 62 and extending longitudinally along the runner 10. Here, a plurality of the indent portions 62 forms a plurality of such channels 74 generally extending parallel to each other. While three indent portions 62 (or channels) are shown on each web 28 and 30, it will be appreciated that fewer or more channels may be provided on each web. The adhesive 56 is disposed in one or more of the channels 74 but need not necessarily be placed in all of the channels.

The adhesive 56 may extend continuously along the channels 74 in a line along the length of runner 10. Alternatively, if the bonding strength of the adhesive 56 is sufficient, the adhesive may be generally uniformly or otherwise spaced along the channels. For example, the adhesive 56 may have spacing that corresponds to openings or penetrations along the runner to further ensure no contact between the forming tools and adhesive. Thus, in one instance, an adhesive line has breaks every 5 cm to avoid slits 18 on the runner. The spacing could also provide longer sections or shorter sections where the adhesive substantially forms a line of dots or beads having other shapes, such as circular, elliptical, or the like.

The profile of each indent portion 62 is shaped to hold the adhesive 56, and in the embodiment shown, is formed by a plurality of generally flat plate portions 66, 68, and 70 where opposing plates 66 and 68 extend obliquely from a main portion of the web 28 or 30 and in merging directions. Both plate portions 66 and 68 extend outwardly to middle plate portion 70 which is spaced laterally from the main portion 72 and generally extends parallel to the main portion 72. It will be understood that in other embodiments, the indent portion 62 may have many other shapes and forms as long as it has a depth sufficient to at least generally restrict the adhesive 56 from flowing out of the space 64 being defined by the indent portion 62. The depth of the indent portion 62, or the total depth of two opposing indent portions, should also be a sufficient depth to substantially contain the adhesive 56 within the space 64 when the adhesive is in an expanded solid state. In one embodiment, the total indent portion depth is approximately 0.5 to 2.0 mm depending on the type of adhesive such that non-swelling adhesives can be placed in shallower indent portions.

In one form, the two opposing web portions 58 and 60 each have at least one indent portion 62 for receiving the adhesive 56. As shown in FIG. 1, instead of a single indent portion 62, two indent portions 62 can oppose each other for receiving a same continuous portion of the adhesive. With this configuration, the adhesive 56 may be conveniently placed in one of the indent portions 66 as the sheet metal forming the runner 10 moves down an assembly line. The adhesive 56 then has space to expand into the opposing indent portion 62 once the sheet metal is folded over.

In other alternative embodiments, indent portions 62 without adhesive in addition to the indents 62 that hold adhesive may be placed on the stalk 12 or flange 16 to further strengthen the runner 10. It is understood that indents alone, in the form of elongate channels, will also increase the torsional stiffness of the runner.

It will also be appreciated that in some alternative embodiments, the adhesive may be placed both in confined areas such as the indent portions 56 and in uncontrolled areas. Thus, for example, the adhesive 56 could be placed in indent portions on the stalk 12 and placed between the unshaped, flat portions of the tables and capping. Alternatively, adhesive could be placed between flat areas of the webs 28 and 30 on the stalk 12 in addition to within the indent portions 62. In such cases, adhesives with different viscosities might be used depending upon whether or not the adhesive is placed within an indent portion 62. Many other combinations are contemplated.

Whether or not the indent portions 62 hold adhesive, it should be noted that the indent portions along the sides of stalk 12 and flange 16 are different and separate from the terminal bulb 26. The bulb 26 is made by both webs 28 and 30 of the stalk 12 while the indent portion 62 may be made by a single web or side 28 or 30. Also, multiple parallel indent portions 62 may be provided as mentioned below to increase the strength of the runner. Thus, the indent portions 62 may be provided in addition to the bulb 26 or the bulb may not be needed when the indents 62 provide sufficient strength.

Figure 2:
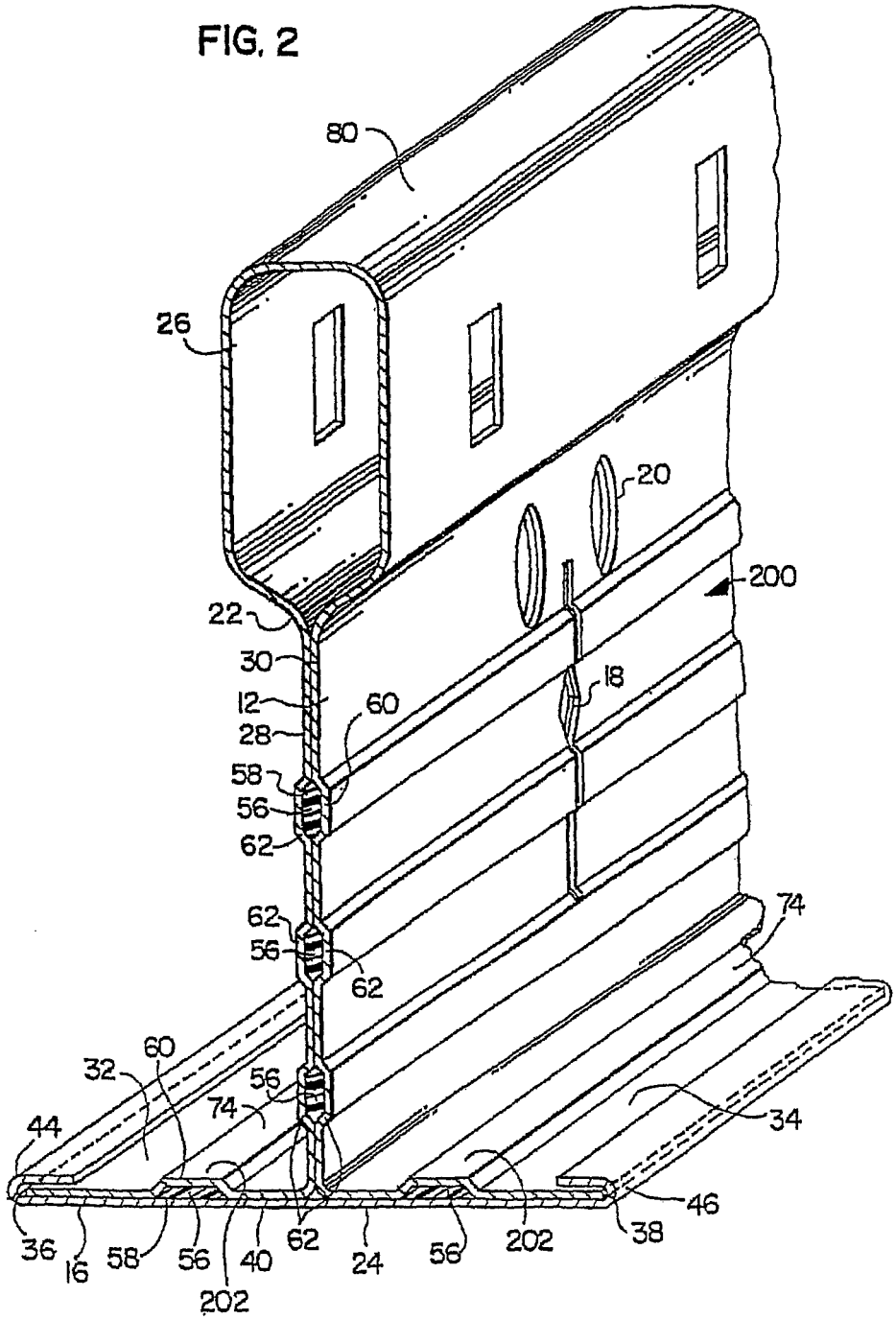
FIG. 2 is a schematic cross-sectional perspective view of a runner for a suspended ceiling grid as configured in accordance with a second embodiment of the present invention.

Referring to FIG. 2, another runner 200 is similar to the runner 10 described above such that a similar structure on both runners are numbered the same. In addition to the structure shown on the above-described runner 10, this runner 200 has additional indent portions 202 formed on the tables 32 and 34 of the flange 16 to confine the adhesive 56 therein. Here, the indent portions 202 have no opposing counter part on the capping 24. It will be understood, however, that additional indent portions opposing indent portions 202 may be provided on the capping 24, especially if they are deemed to be aesthetically acceptable when viewed from below the ceiling grid or if the capping is hidden from view by adjacent ceiling panels or other structure. It will be understood that the indent portions 202 may be placed on the capping 24 instead of the tables 32 and 34, and that each side of the flange 16 (left or right) may have one or more indent portions 202. Additionally, the left side of the flange 16 may have the same or a different number of indent portions (including zero) than the right side of the flange 16.

Figure 3:
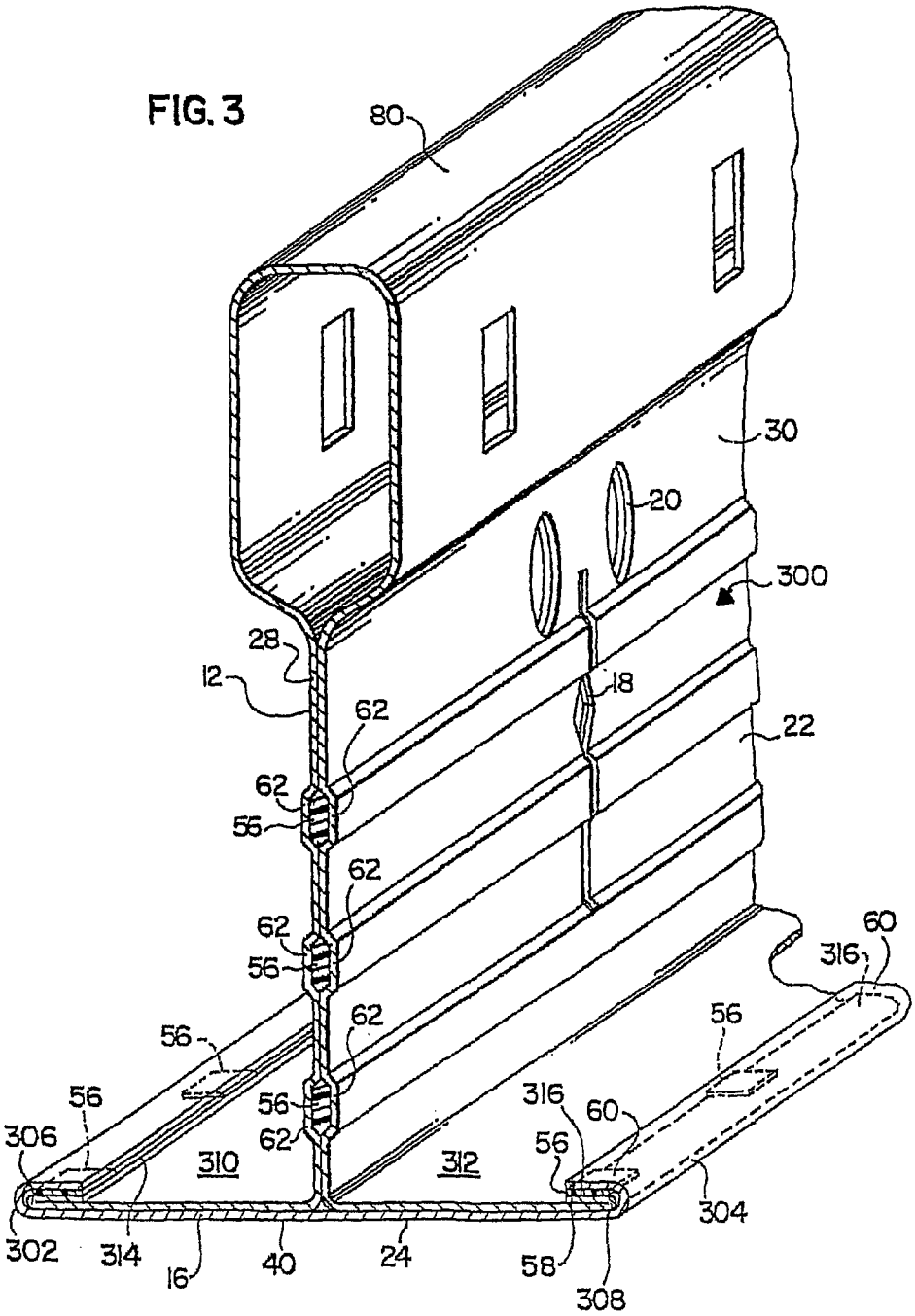
FIG. 3 is a schematic cross-sectional perspective view of a runner for a suspended ceiling grid as configured in accordance with a third embodiment of the present invention.

Referring to FIG. 3, yet another runner 300, also similar to the first runner 10 described above, similarly has indent portions 62 and adhesive 56 on the stalk 12. For this embodiment, however, this runner 300 has overturned portions 302 and 304 extending from the capping 24 as well as overturned portions 306 and 308 that respectively extend from opposite ends of tables 310 and 312. The overturned portions 306 and 308 align respectively with the overturned portions 302 and 304. All of the overturned portions 302, 304, 310, 312 curl upward and then inward. The outer overturned portions 302 and 304 from the capping 24 also curl upward and inward from below the tables 310 and 312, around the ends of the overturned portions 306 and 308 of the tables, and above upper surfaces 314 and 316 of the overturned portions 306 and 308. In one embodiment, no adhesive is used and the combination of the curled overturned portions 302, 304, 306, 308 provides a significant increase in flexural load bearing capacity even when no other connector is used between the overturned portions 302 and 306 on the left side and the overturned portions 304 and 308 on the right side. In an alternative embodiment, adhesive 56 is disposed between at least one of the upper surfaces 314 and 316 of the overturned portions 306 and 308 (and defining one of the web portions 58) and the overturned portions 302 and 304 (defining the other web portion 60). In the illustrated embodiment, the adhesive 56 is placed at both overturned portions 302 and 304 although this need not always be the case. This configuration further increases the flexural load bearing capacity of the runner 300, and it will be understood that adhesive may be placed only at the overturned portions 302 and 304 or overturned portions may be provided as described with or without any other channels on the runner 300.

It will also be understood that either or both the flange 16 or stalk 12 of the runner 300 may have one or more indent portions 62, whether or not holding adhesive as described above for any of the runner embodiments, to further increase flexural load bearing capacity if placed on the flange 16 or to increase torsional stiffness if placed on the stalk 12.

For some of the embodiments described herein, the indent portions 62 and 202 can be integrally formed with the at least one web portions 28 and 30 by a cold roll forming process although other options are contemplated. To form the grid profile on the runner 10, 200, or 300, a strip of sheet metal passes through a set of roll forms or roll formers, and with each pass of an individual roll former, the sheet metal is brought closer to the shape of the final profile. On one of these passes, at least one indent portion 62 or 202 is formed on a web member of the runner. An adhesive, whether or not expandable, may be placed in the at least one indent while the profile is between two roll forming passes. Sponge rollers may be used to apply moisture to the runner when the adhesive is a moisture curing type of adhesive. While the adhesive may be applied by spraying, direct application in bead form generally uniformly along the length of the runner (or in any other desired spacing) is preferred because spraying often requires fume extraction.

After placing the adhesive in the at least one indent portion, one or more additional roll formers move on the web member for further shaping of the runner. The roll former may pass over the adhesive in the indent portions when the adhesive is applied to that side of the sheet metal that will be in direct contact with the roll formers. Due to the depth of the indent portions, the adhesive is maintained out of contact with the roll formers. Subsequently, the indent portion also provides sufficient space to substantially maintain the adhesive out of contact with any of the other forming tools, such as a punch or press 76, which is used to penetrate the runners.

In one of the subsequent roll form passes after the adhesive is in place in the indent portion, the roll formers fold the web member to form the two opposing web portions 58 and 60 which places the adhesive between the two opposing web portions. As mentioned above, if the adhesive is expandable, the indent portion or portions should have sufficient dimensions to permit the adhesive to expand without substantially bending, denting, or undesirably deforming the web member.

So configured, ceiling grid runners can be reliably formed of economical materials that will otherwise meet the various requirements for quality components in this regard. The lack of strength that such economical materials might otherwise present can be effectively overcome by the use of an adhesive. At the same time, economical manufacturing processes can be used that do not present significant quality, cycle time, and/or maintenance issues due to the use of adhesive in a line operation (including relatively high-speed line operations). Those skilled in the art will also recognize and appreciate that these teachings are readily scaled to meet a variety of needs and can be readily applied in a variety of application settings to leverage a wide variety of existing practices and grid runner designs.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The invention claimed is:

1. An elongated element for use in a suspended ceiling grid, comprising:

a stalk portion;

a flange portion;

the stalk and flange portion being connected;

in at least one of the stalk and flange portion, a double layer with at least one longitudinally extending indent portion covered by one of the layers and adapted to provide an increase in torsional resistance of the element, and an adhesive connecting the layers of the double layer together and being confined exclusively to one or more indent portion.

2. An element according to claim 1, the flange portion extending laterally on one side of the plane of the stalk portion whereby to provide an element of substantially L-shape in end elevation.

3. An element according to claim 1, the flange portion extending laterally on both sides of the plane of the stalk portion, whereby to provide an element of substantially T-shape in end elevation.

4. An elongated element for use in a suspended ceiling grid, comprising:

a stalk portion;

a flange portion;

the stalk and flange portion being connected;

and in at least one of the stalk and flange portion, a double layer with at least one longitudinally extending indent portion closed exclusively by one of the layers, adapted to provide an increase in torsional resistance of the element, and containing an adhesive that when disposed exclusively in one or more of the at least one indent portions is capable of interconnecting the layers of the double layer to further increase the torsional resistance of the elements.

5. A runner for a suspended ceiling grid, comprising:
two opposing web portions;
two flange portions;
at least one distinct indent portion;
the at least one indent portion located on
at least one of the web portions; or
at least one of the flange portions; or
at least one of the web portions and at least one of the flange portions,
the indent portion being covered by a web portion or a flange portion, further comprising an adhesive disposed exclusively in one or more of the at least one indent portions.

6. The runner of claim 5, wherein the at least one indent portion is integrally formed with at least one of the two opposing web portions.

7. The runner of claim 6, wherein both of the two opposing web portions each have at least one indent portion.

8. The runner of claim 7, wherein the opposing web portions have multiple indent portions and the indent portions oppose each other and receive a same continuous portion of the adhesive.

9. The runner of claim 5, further comprising a stalk, and the flanges extend transversely to the stalk, the flanges comprising two oppositely extending tables connected to the stalk, at least one capping disposed beneath at least one of the tables, and wherein one or more of the at least one indent portions is formed by one of the tables and the capping for holding the adhesive.

10. The runner of claim 5, wherein the two flange portions form at least one table with at least one upwardly facing surface, and the runner further comprises a lower capping portion generally extending beneath the at least one table, the lower capping portion having at least one overturned portion extending from below the at least one table and to above the upwardly facing surface, and wherein an adhesive is disposed between the upwardly facing surface and the overturned portion.

11. A runner for a suspended ceiling grid, comprising:
an upper portion with an upwardly facing surface;
a lower capping portion generally disposed beneath the upper portion;
at least one overturned portion to connect the lower capping portion to the upper portion, the at least one overturned portion extending from below the upper portion to above a limited portion of the upwardly facing surface of the upper portion; and
an adhesive disposed between the limited portion of the upwardly facing surface and the at least one overturned portion, the adhesive being excluded from a remaining portion of the upwardly facing surface that the overturned portion is not above.

12. A method of forming an element for a suspended ceiling grid, comprising the steps of:
forming at least one longitudinal indent on an elongated web member;
placing an adhesive in one or more of the at least one indent; and
after placing the adhesive in one or more of the at least one indent, moving a forming tool on the web member, to close a space of fixed volume wherein the at least one indent that contains the adhesive provides sufficient space with said fixed volume to maintain a quantity of adhesive adequate to interconnect the web member to another part of the grid element in the at least one indent and out of contact with the forming tool.

13. A method of forming an element for a suspended ceiling grid, comprising the steps of:
forming at least one longitudinal indent on an elongated web member;
placing an expandable adhesive in one or more of the at least one indent; and
folding the web member to form two opposing web portions wherein the adhesive is disposed between the two opposing web portions, and wherein the at least one indent has sufficient dimensions to permit the adhesive to expand without substantially deforming the web member.

14. A runner for a suspended ceiling grid, comprising:
an upper reinforcing bulb;
two opposing web portions below the bulb;
two flange portions below the web portions;
a plurality of indent portions located on each of the web portions, the indent portions being vertically spaced from one another on their respective web portion so as to be located in both a lower half and an upper half of the respective web portion, the indent portions being longitudinally continuous along substantially the full length of the runner, the indents of both webs projecting laterally in opposite directions from a center of the runner a distance substantially less than a distance the reinforcing bulb projects laterally from the center of the runner.

15. The runner of claim 14, wherein the indent portions have generally flat plate elements laterally spaced from the respective web portion proper, the flat plate elements having a vertical height exceeding their lateral spacing from their respective web portion proper.

16. The runner of claim 15, wherein an adhesive securing said web portions together is present in at least two opposing indent portions.

17. The runner of claim 16, wherein the adhesive is located exclusively in said indent portions.

* * * * *